US007957960B2

(12) United States Patent
Chen

(10) Patent No.: US 7,957,960 B2
(45) Date of Patent: Jun. 7, 2011

(54) AUDIO TIME SCALE MODIFICATION USING DECIMATION-BASED SYNCHRONIZED OVERLAP-ADD ALGORITHM

(75) Inventor: Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 1171 days.

(21) Appl. No.: 11/583,715

(22) Filed: Oct. 20, 2006

(65) Prior Publication Data

US 2007/0094031 A1 Apr. 26, 2007

Related U.S. Application Data

(60) Provisional application No. 60/728,296, filed on Oct. 20, 2005.

(51) Int. Cl.
*G10L 19/14* (2006.01)
*G10L 13/00* (2006.01)
*G10L 13/06* (2006.01)

(52) U.S. Cl. ..... 704/211; 704/267

(58) Field of Classification Search ..... 704/211, 704/267

See application file for complete search history.

(56) References Cited

U.S. PATENT DOCUMENTS 5,175,769 A * 12/1992 Hejna et al. ..... 704/211
5,353,374 A * 10/1994 Wilson et al. ..... 704/226
6,150,598 A * 11/2000 Suzuki et al. ..... 84/603
6,952,668 B1 * 10/2005 Kapilow ..... 704/206
6,999,922 B2 * 2/2006 Boillot et al. ..... 704/216
7,143,032 B2 11/2006 Chen
7,236,927 B2 6/2007 Chen
7,308,406 B2 12/2007 Chen
7,529,661 B2 5/2009 Chen
7,590,525 B2 9/2009 Chen
2003/0074197 A1 4/2003 Chen
2003/0177002 A1 9/2003 Chen
2005/0137729 A1 * 6/2005 Sakurai et al. ..... 700/94

OTHER PUBLICATIONS

Roucos et al., "High Quality Time-Scale Modification for Speech", ICASSP'85, vol. 10, Apr. 1985, pp. 493-496.
Wong et al., "Fast Time Scale Modification Using Envelope-Matching Technique (EM-TSM)", Circuits and Systems, 1998, ISCAS'98, vol. 5, May 31-Jun. 3, 1998, pp. 550-553.
Wong et al., "Fast Sola-Based Time Scale Modification Using Modified Envelope Matching", Acoustics, ICASSP'02, Aug. 7, 2002, vol. 3, pp. III-3188 thru III-3191.

* cited by examiner

*Primary Examiner* — Eric Yen
(74) *Attorney, Agent, or Firm* — Sterne, Kessler, Goldstein & Fox P.L.L.C.

(57) ABSTRACT

A high-quality, low-complexity audio time scale modification (TSM) algorithm useful in speeding up or slowing down the playback of an encoded audio signal without changing the pitch or timbre of the audio signal. The TSM algorithm uses a modified synchronized overlap-add (SOLA) algorithm that maintains a roughly constant computational complexity regardless of the TSM speed factor and that performs most of the required SOLA computation using decimated signals, thereby reducing computational complexity by approximately two orders of magnitude.

33 Claims, 7 Drawing Sheets

AUDIO TIME SCALE MODIFICATION USING DECIMATION-BASED SYNCHRONIZED OVERLAP-ADD ALGORITHM

CROSS-REFERENCE TO RELATED APPLICATIONS

This application claims priority to U.S. Provisional Patent Application No. 60/728,296, filed Oct. 20, 2005, the entirety of which is incorporated by reference herein.

BACKGROUND OF THE INVENTION

1. Field of the Invention

The present invention generally relates to audio time scale modification algorithms.

2. Background

In the area of digital video technology, it would be beneficial to be able to speed up or slow down the playback of an encoded audio signal without substantially changing the pitch or timbre of the audio signal. One particular application of such time scale modification (TSM) of audio signals might include the ability to perform high-quality playback of stored video programs from a personal video recorder (PVR) at some speed that is faster than the normal playback rate. For example, it may be desired to play back a stored video program at a 20% faster speed than the normal playback rate. In this case, the audio signal needs to be played back at 1.2× speed while still maintaining high signal quality. However, the TSM algorithm may need to be of sufficiently low complexity such that it can be implemented in a system having limited processing resources.

One of the most popular types of prior-art audio TSM algorithms is called Synchronized Overlap-Add, or SOLA. See S. Roucos and A. M. Wilgus, "High Quality Time-Scale Modification for Speech", *Proceedings of* 1985 *IEEE International Conference on Acoustic, Speech, and Signal Processing*, pp. 493-496 (March 1985), which is incorporated by reference in its entirety herein. However, if this original SOLA algorithm is implemented as is for even just a single 44.1 kHz mono audio channel, the computational complexity can easily reach 100 to 200 mega-instructions per second (MIPS) on a ZSP400 digital signal processing (DSP) core (a product of LSI Logic Corporation of Milpitas, Calif.). Thus, this approach will not work for a similar DSP core that has a processing speed on the order of approximately 100 MHz. Many variations of SOLA have been proposed in the literature and some are of a reduced complexity. However, most of them are still too complex for an application scenario in which a DSP core having a processing speed of approximately 100 MHz has to perform both audio decoding and audio TSM.

Accordingly, what is desired is a high-quality audio TSM algorithm that provides the benefits of the original SOLA algorithm but that is far less complex, such that it may be implemented in a system having limited processing resources.

BRIEF SUMMARY OF THE INVENTION

The present invention is directed to a high-quality, low-complexity audio time scale modification (TSM) algorithm useful in speeding up or slowing down the playback of an encoded audio signal without changing the pitch or timbre of the audio signal. A TSM algorithm in accordance with an embodiment of the present invention uses a modified version of the original synchronized overlap-add (SOLA) algorithm that maintains a roughly constant computational complexity regardless of the TSM speed factor. A TSM algorithm in accordance with an embodiment of the present invention also performs most of the required SOLA computation using decimated signals, thereby reducing computational complexity by approximately two orders of magnitude.

An example implementation of an algorithm in accordance with the present invention achieves fairly high audio quality, and can be configured to have a computational complexity on the order of only 2 to 3 MIPS on a ZSP400 DSP core. The memory requirement for such an implementation naturally depends on the audio sampling rate, but can be controlled to be below 4 kilowords per audio channel.

In particular, an example method for time scale modifying an input audio signal in accordance with an embodiment of the present invention is provided herein. The method includes various steps. First, a waveform similarity measure or waveform difference measure is calculated between a decimated portion of a second waveform segment of the input audio signal and each of a plurality of portions of a decimated first waveform segment of the input audio signal to identify an optimal time shift in a decimated domain. Then, an optimal time shift is identified in an undecimated domain based on the identified optimal time shift in the decimated domain. After this, a portion of the first waveform segment identified by the optimal time shift in the undecimated domain is overlap added with the portion of the second waveform segment to produce an overlap-added waveform segment. Finally, at least a portion of the overlap-added waveform segment is provided as a time scale modified audio output signal.

Furthermore, a system for time scale modifying an input audio signal in accordance with an embodiment of the present invention is also described herein. The system includes an input buffer, an output buffer, and time scale modification (TSM) logic coupled to the input buffer and the output buffer. The TSM logic is configured to decimate a first waveform segment of the input audio signal stored in the output buffer by a decimation factor to produce a decimated first waveform segment and to decimate a portion of a second waveform segment of the input audio signal stored in the input buffer by the decimation factor to produce a decimated portion of the second waveform segment. The TSM logic is further configured to calculate a waveform similarity measure between the decimated portion of the second waveform segment and each of a plurality of portions of the decimated first waveform segment to identify an optimal time shift in a decimated domain and to identify an optimal time shift in an undecimated domain based on the identified optimal time shift in the decimated domain. The TSM logic is still further configured to overlap add a portion of the first waveform segment identified by the optimal time shift in the undecimated domain with the portion of the second waveform segment to produce an overlap-added waveform segment and to store at least a portion of the overlap-added waveform segment in the output buffer for output as a time scale modified audio output signal.

An alternative system for time scale modifying an input audio signal in accordance with an embodiment of the present invention includes an input buffer, an output buffer, and time scale modification (TSM) logic coupled to the input buffer and the output buffer. The TSM logic is configured to decimate a first waveform segment of the input audio signal stored in the output buffer by a decimation factor to produce a decimated first waveform segment and to decimate a portion of a second waveform segment of the input audio signal stored in the input buffer by the decimation factor to produce a decimated portion of the second waveform segment. The TSM logic is further configured to calculate a waveform difference measure between the decimated portion of the second waveform segment and each of a plurality of portions of the decimated first waveform segment to identify an optimal time shift in a decimated domain and to identify an optimal time shift in an undecimated domain based on the identified optimal time shift in the decimated domain. The TSM logic is still further configured to overlap add a portion of the first waveform segment identified by the optimal time shift in the undecimated domain with the portion of the second waveform segment to produce an overlap-added waveform segment and to store at least a portion of the overlap-added waveform segment in the output buffer for output as a time scale modified audio output signal.

Additionally, a computer program product in accordance with an embodiment of the present invention is described herein. The computer program product includes a computer useable medium having computer program logic recorded thereon for enabling a processor in a computer system to time scale modify an input audio signal. The computer program logic includes first, second, third and fourth means. The first means are for enabling the processor to calculate a waveform similarity measure between a decimated portion of a second waveform segment of the input audio signal and each of a plurality of portions of a decimated first waveform segment of the input audio signal to identify an optimal time shift in a decimated domain. The second means are for enabling the processor to identify an optimal time shift in an undecimated domain based on the identified optimal time shift in the decimated domain. The third means are for enabling the processor to overlap add a portion of the first waveform segment identified by the optimal time shift in the undecimated domain with the portion of the second waveform segment to produce an overlap-added waveform segment. The fourth means are for enabling the processor to provide at least a portion of the overlap-added waveform segment as a time scale modified audio output signal.

An alternative computer program product in accordance with an embodiment of the present invention includes a computer useable medium having computer program logic recorded thereon for enabling a processor in a computer system to time scale modify an input audio signal. The computer program logic includes first, second, third and fourth means. The first means are for enabling the processor to calculate a waveform difference measure between a decimated portion of a second waveform segment of the input audio signal and each of a plurality of portions of a decimated first waveform segment of the input audio signal to identify an optimal time shift in a decimated domain. The second means are for enabling the processor to identify an optimal time shift in an undecimated domain based on the identified optimal time shift in the decimated domain. The third means are for enabling the processor to overlap add a portion of the first waveform segment identified by the optimal time shift in the undecimated domain with the portion of the second waveform segment to produce an overlap-added waveform segment. The fourth means are for enabling the processor to provide at least a portion of the overlap-added waveform segment as a time scale modified audio output signal.

A method for time scale modifying a plurality of audio signals, wherein each of the audio signals is associated with a different audio channel, is further provided. The method includes down-mixing the plurality of audio signals to produce a mixed-down audio signal, calculating a waveform similarity measure or waveform difference measure to identifying an optimal time shift between first and second waveform segments of the mixed-down audio signal, and overlap adding first and second waveform segments of each of the plurality of audio signals based on the optimal time shift to produce a plurality of time scale modified audio signals. Calculating a waveform similarity measure or waveform difference measure to identify an optimal time shift between first and second waveform segments of the mixed-down audio signal may include calculating the waveform similarity measure or waveform difference measure in a decimated domain.

Further features and advantages of the present invention, as well as the structure and operation of various embodiments thereof, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

FIG. 1 an example audio decoding system that uses a time scale modification algorithm in accordance with an embodiment of the present invention.

Figure 1:
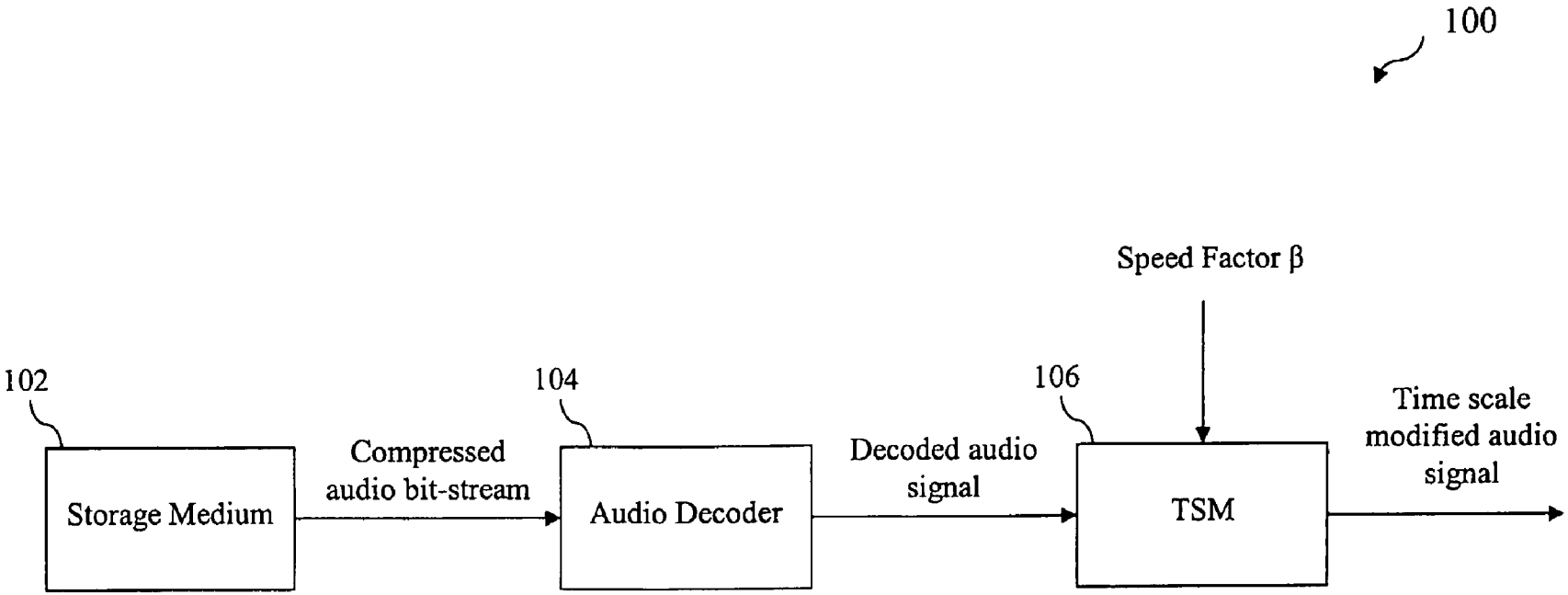

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

1. Introduction

In this detailed description, the basic concepts underlying traditional Overlap-Add (OLA) and Synchronized Overlap-Add (SOLA) algorithms as well as some basic concepts underlying a modified SOLA algorithm in accordance with the present invention will be described in Section 2. This will be followed by a detailed description of an embodiment of the inventive modified SOLA algorithm in Section 3. Next, in Section 4, alternative input/output buffering schemes with trade-off between programming simplicity and efficiency in memory usage will be described. In Section 5, the use of circular buffers to eliminate shifting operations in an embodiment of the present invention is described. In Section 6, a specific example configuration of a modified SOLA algorithm in accordance with an embodiment of the present invention that is intended for use with an AC-3 audio decoder operating at a sampling rate of 44.1 kHz and a speed factor of 1.2 will be described. In Section 7, some general issues of applying time scale modification (TSM) to stereo or general multi-channel audio signals will be discussed. In Section 8, the possibility of further reducing the computational complexity of a modified SOLA algorithm in accordance with an embodiment of the present invention will be considered. In Section 9, an example computer system implementation of the present invention is described. Some concluding remarks will be provided in Section 10.

2. Basic Concepts

2.1. Example Audio Decoding System

FIG. 1 illustrates an example audio decoding system 100 that uses a TSM algorithm in accordance with an embodiment of the present invention. In particular, and as shown in FIG. 1, example system 100 includes a storage medium 102, an audio decoder 104 and time scale modifier 106 that applies a TSM algorithm to an audio signal in accordance with an embodiment of the present invention. From the system point of view, TSM is a post-processing algorithm performed after the audio decoding operation, which is reflected in FIG. 1.

Storage medium 102 may be any medium, device or component that is capable of storing compressed audio signals. For example, storage medium 102 may comprise a hard drive of a Personal Video Recorder (PVR), although the invention is not so limited. Audio decoder 104 operates to receive a compressed audio bit-stream from storage medium 102 and to decode the audio bit-stream to generate decoded audio samples. By way of example, audio decoder 104 may be an AC-3, MP3 or AAC audio decoding module that decodes the compressed audio bit-stream into pulse-code modulated (PCM) audio samples. Time scale modifier 106 then processes the decoded audio samples to change the apparent playback speed without substantially altering the pitch or timbre of the audio signal. For example, in a scenario in which a 1.2× speed increase is sought, time scale modifier 106 operates such that, on average, every 1.2 seconds worth of decoded audio signal is played back in only 1.0 second. The operation of time scale modifier 106 is controlled by a speed factor $\beta$. In the foregoing case where a 1.2× speed increase is sought, the speed factor $\beta$ is 1.2.

It will be readily appreciated by persons skilled in the art that the functionality of audio decoder 104 and time scale modifier 106 as described herein may be implemented as hardware, software or as a combination of hardware and software. In an embodiment of the present invention, audio decoder 104 and time scale modifier 106 are integrated components of a device, such as a PVR, that includes storage medium 102, although the invention is not so limited.

Figure 2:
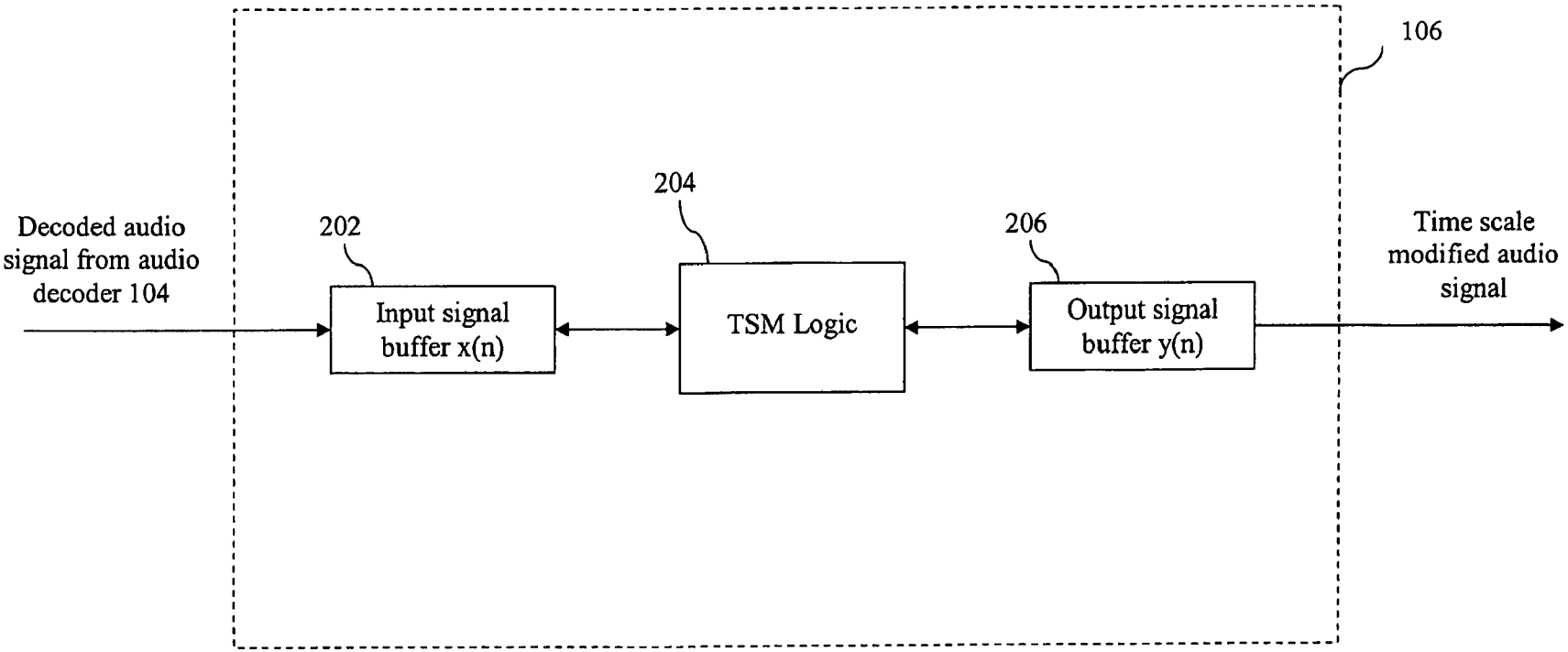
FIG. 2 illustrates an example arrangement of an input signal buffer, time scale modification logic and an output signal buffer in accordance with an embodiment of the present invention.

In one embodiment of the present invention, time scale modifier 106 includes two separate long buffers that are used by TSM logic for performing TSM operations as will be described in detail herein: an input signal buffer x(n) and an output signal buffer y(n). Such an arrangement is depicted in FIG. 2, which shows an embodiment in which time scale modifier 106 includes an input signal buffer 202, TSM logic 204, and an output signal buffer 206. In accordance with this arrangement, input signal buffer 202 contains consecutive samples of the input signal to TSM logic 204, which is also the output signal of audio decoder 104. As will be explained in more detail herein, output signal buffer 206 contains signal samples that are used to calculate the optimal time shift for the input signal before an overlap-add operation, and then after the overlap-add operation it also contains the output signal of TSM logic 204.

2.2. The OLA Algorithm

To understand the modified SOLA algorithm in accordance with the present invention, one needs first to understand the traditional SOLA method, and to understand the traditional SOLA method, it would help greatly to understand the OLA method first. In OLA, a segment of waveform is taken from an input signal at a fixed interval of once every SA samples ("SA" stands for "Size of Analysis frame"), then it is overlap-added with a waveform stored in an output buffer at a fixed interval of once every SS samples ("SS stands for "Size of Synthesis frame"). The overlap-add result is the output signal. The input-output timing relationship of OLA is illustrated at a conceptual level in FIG. 3 for a speed factor of $\beta=2.5$. The analysis frame size SA is the product of the speed factor $\beta$ and the synthesis frame size SS; that is, $SA=\beta\cdot SS$, which is 2.5×SS in the example of FIG. 3.

Figure 3:
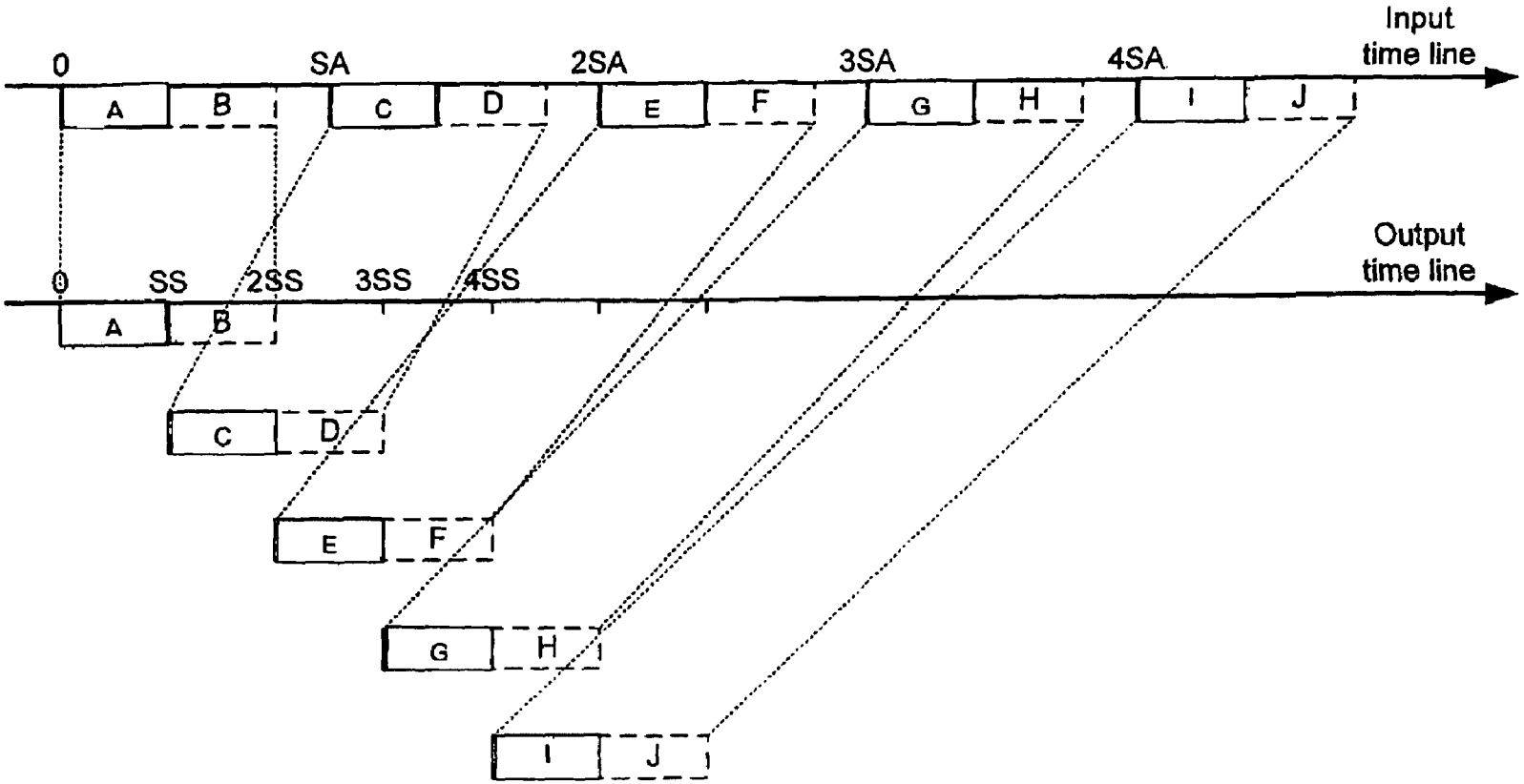
FIG. 3 is a conceptual illustration of the input-output timing relationship using a traditional Overlap-Add (OLA) method.

The input waveform is divided into blocks A, B, C, D, E, F, G, H, . . . , etc., as shown in FIG. 3. Each of the waveform blocks has SS input samples. On a conceptual level, the operation of the OLA method is very simple. At a fixed interval, two adjacent blocks are taken from the input signal with the starting point of the two blocks being SA samples later than the starting point of the last two blocks taken. Each pair of input blocks is copied to the output time line in the manner shown in FIG. 3. The dotted lines indicate how a pair of input blocks is copied to the output time line. Each new pair of blocks in the output is SS samples later than the last pair of blocks. Then, the second half of each pair of blocks (blocks B, D, F, H, J, . . . ) is multiplied by a "fade-out" window, which can be as simple as a ramp-down triangular window, and the first half of each pair of blocks except the very first pair (blocks C, E, G, I, . . . ) is multiplied by a "fade-in" window, which can be a ramp-up triangular window. After such windowing, for each time period of SS samples, the two windowed blocks that are vertically aligned in FIG. 3 are overlap-added. For example, block B is overlap-added with block C, and block D is overlap-added with block E, and so on. The resulting waveform of such overlap-add operation is the output signal of the OLA method.

By inspecting FIG. 3, it should be obvious that an input signal sample located at the sample index of n×SA will appear at the sample index of n×SS in the OLA output signal before being overlap-added. Therefore, the time scale is compressed by a factor of $SA/SS=\beta=2.5$. In other words, the output signal is 2.5 times shorter and thus will play back at a speed that is 2.5 times faster than the normal playback rate if the sampling rate stays the same.

It should be noted that a speed factor of $\beta=2.5$ was intentionally selected for the example of FIG. 3 so that different pairs of input waveform blocks do not overlap each other. This is purely for convenience of illustration. In reality, the speed factor $\beta$ can be any positive number. When $\beta<2$, there will be overlap between pairs of input blocks. For example, if β=1.5, then those input signal samples in the second half of block B will also be in the first half of block C because SA=1.5×SS in this case.

The purpose of the overlap-add operation is to achieve a gradual and smooth transition between two blocks of different waveforms. This operation can eliminate waveform discontinuity that would otherwise occur at the block boundaries.

Although the OLA method is very simple and it avoids waveform discontinuities, its fundamental flaw is that the input waveform is copied to the output time line and overlap-added at a rigid and fixed time interval, completely disregarding the properties of the two blocks of underlying waveforms that are being overlap-added. Without proper waveform alignment, the OLA method often leads to destructive interference between the two blocks of waveforms being overlap-added, and this causes fairly audible wobbling or tonal distortion.

2.3. Traditional SOLA Algorithm

Synchronized Overlap-Add (SOLA) solves the foregoing problem by copying the input waveform block to the output time line not at a fixed time interval like OLA, but at a location near where OLA would copy it to, with the optimal location (or optimal time shift from the OLA location) chosen to maximize some sort of waveform similarity measure between the two blocks of waveforms to be overlap-added. Since the two waveforms being overlap-added are maximally similar, destructive interference is greatly minimized, and the resulting output audio quality can be very high, especially for pure voice signals. This is especially true for speed factors close to 1, in which case the SOLA output voice signal sounds completely natural and essentially distortion-free.

In the context of FIG. 3, the operation of SOLA can be explained as follows. When copying input waveform block C to the output time line, rather than placing the starting point of block C at sample index SS as in OLA, the traditional SOLA method would allow the starting point of block C to be in a range from sample index 0 to 2SS− that is, with a time shift between—SS and SS samples relative to the block C location of OLA. The optimal time shift is determined by maximizing a waveform similarity measure (or equivalently, minimizing a waveform difference measure) between the sliding block C and the waveform in blocks A and B from sample index 0 to 2SS. Similarly, when copying input block E to the output time line, block E is allowed to have a time shift between −SS and SS samples relative to the fixed block E location of OLA as shown in FIG. 3. In other words, the starting point of block E will be somewhere between sample index SS and 3SS. Similarly, the starting point of block G will be somewhere between sample index 2SS and 4SS, and so on.

It should be noted that there exist many possible waveform similarity measures or waveform difference measures that can be used to judge the degree of similarity or difference between two pieces of waveforms. A common example of a waveform similarity measure is the so-called "normalized cross correlation", which is defined in Section 3 later. Another example is just the plain cross-correlation without normalization. A common example of a waveform difference measure is the so-called Average Magnitude Difference Function (AMDF), which was often used in some of the early pitch extraction algorithms and is well-known by persons skilled in the art. By maximizing a waveform similarity measure, or equivalently, minimizing a waveform difference measure, one can find an optimal time shift that corresponds to maximum likeness or minimum difference between two pieces of waveforms, thus after such two pieces of waveforms are overlapped and added, it results in the minimum degree of destructive interference or partial waveform cancellation.

For convenience of discussion, in the rest of this document only normalized cross-correlation will be mentioned in describing example embodiments of the present invention. However, persons skilled in the art will readily appreciate that similar results and benefits may be obtained by simply substituting another waveform similarity measure for the normalized cross-correlation, or by replacing it with a waveform difference measure and then reversing the direction of optimization (from maximizing to minimizing). Thus, the description of normalized cross-correlation in this document should be regarded as just an example and is not limiting.

Some researchers of SOLA have noted that the same audio quality can be achieved by limiting the allowable time shift to be between 0 and SS samples rather than between −SS and SS samples. For example, rather than allowing the starting point of block C to be between sample index 0 and 2SS, it can be limited to be between sample index SS and 2SS. Similarly, the starting point of block E is limited to the range between sample index 2SS and 3SS. This cuts the complexity of optimal time shift search by half. Furthermore, it also allows earlier release of block A to be played out before starting the search of the optimal location for block C (and earlier release of the overlap-added version between block B and C before searching for the optimal location for block E, and so on). In a modified implementation of SOLA in accordance with an embodiment of the present invention, this change of limiting the time shift to one side has also been adopted.

In an embodiment of the present invention, another change was made from the traditional SOLA. In the traditional SOLA, as one slides block C toward the right direction in FIG. 3, the overlapping portion between blocks B and C becomes progressively shorter until it reaches a length of only one sample. This will make the normalized cross-correlation increasingly unreliable as a waveform similarity measure. To overcome this problem, an additional block B' of SS sample right after (to the right of) block B is included in order to maintain a constant length of overlapped portion with block C when one slides block C from a time shift of 0 to a time shift of SS samples. This is illustrated in FIG. 4, again for the speed factor of β=2.5. To avoid confusion to the eyes, the dotted lines in FIG. 3 are not shown in FIG. 4.

Figure 4:
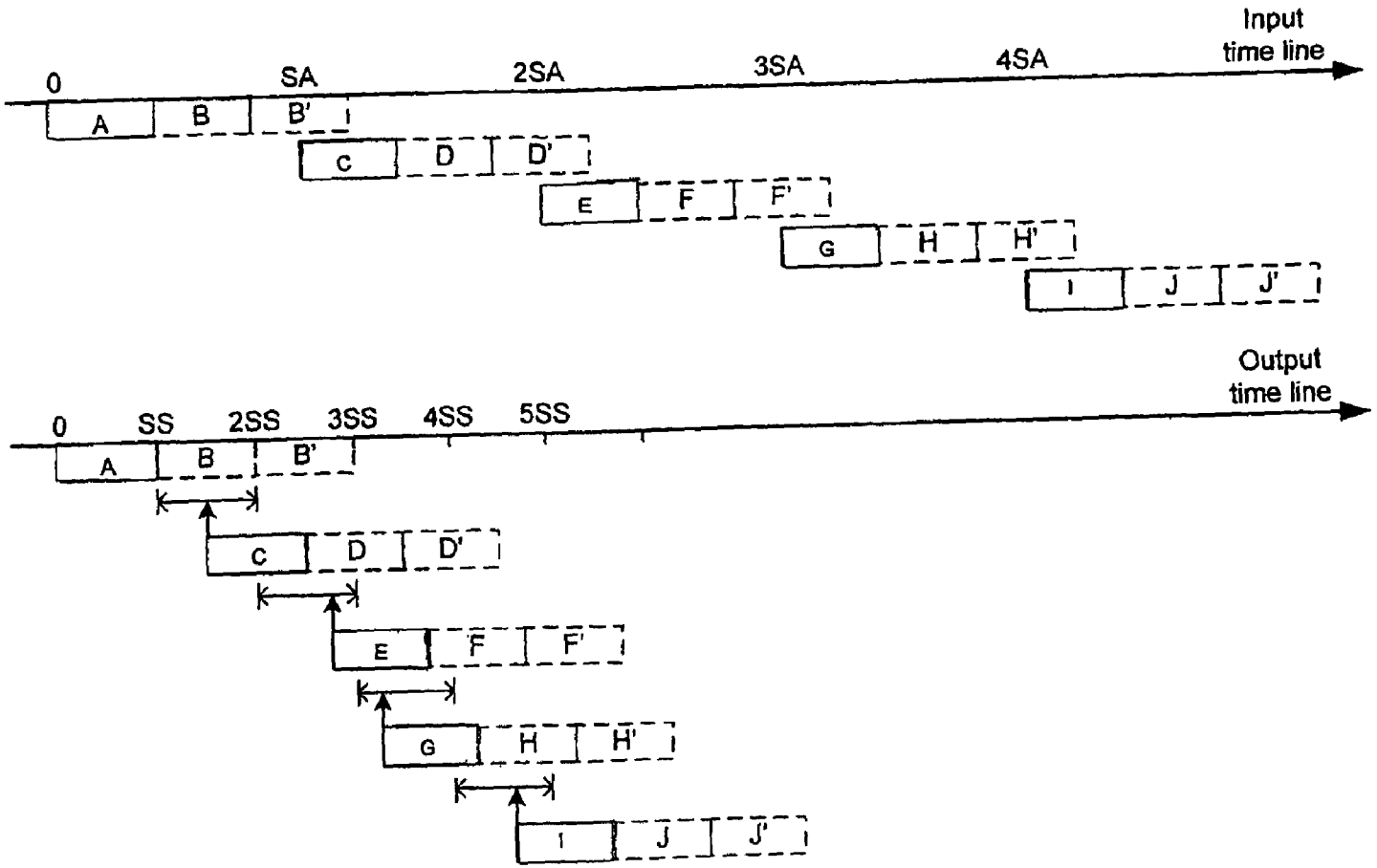
FIG. 4 is a conceptual illustration of an input-output timing relationship using a modified Synchronized Overlap-Add (SOLA) method in accordance with an embodiment of the present invention.

In FIG. 4, above each block beneath the output time line, a horizontal double arrow indicates the allowable range for the starting point of that block, while the short upward arrow at the starting point of that block indicates the optimal location that maximizes a waveform similarity measure within that allowable range. Every waveform block in FIG. 4 has SS waveform samples.

The step-by-step operation of a modified SOLA algorithm in accordance with an embodiment of the present invention is now described with reference to FIG. 4. At the start of the modified SOLA algorithm, the input waveform block A is copied to the output and released for playback. The input waveform blocks B and B' are then copied to the output buffer. Next, the input waveform blocks C, D, and D' are copied to the input buffer. Block C, which starts at input sample index SA, is then used as a template that slides in the allowable range in the output time line as indicated in FIG. 4 while the normalized cross-correlation is calculated. That is, initially block C coincides with block B, and the normalized cross-correlation value is calculated. Next, block C is shifted to the right by one sample to overlap with the last SS−1 samples of block B and the first sample of block B', and normalized cross-correlation value of the two overlapped waveform segments is calculated, then block C is shifted to the right by another sample. This process continues until block C coincides with block B', after which a total of SS+1 normalized cross-correlation values will have been calculated. The time shift corresponding to the maximum of these SS+1 normalized cross-correlation values is used as the final location of block C.

For convenience of description and without loss of generality, suppose that the optimal time shift for block C happens to be SS/2 samples, exactly half way in the middle of the allowable range as shown in FIG. 4. Then, the next step is to apply a fade-out window to the second half of block B and the first half of block B', apply a fade-in window to block C, and then overlap-add the two windowed waveform segments in the output buffer (which now contains blocks B and B'). After the overlap-add operation, the first SS samples of the output buffer, which correspond to the previous block B, are released to output for playback. Then, the second half of overlap-added samples, which is located from the (SS+1)th sample to the (SS+SS/2)th sample in the output buffer, is shifted by SS samples to the beginning portion, or the first quarter, of the output buffer. (This shifting operation can be avoided by using a circular buffer, as is well-known in the art, but here it will be described as a shifting operation for convenience of description.) Next, the remaining three-quarters of the output buffer are filled by copying the (3/2)×SS input signal samples immediately following block C. That is, the entire block D and the first half of block D' are copied from the input buffer to fill the remaining portion of the output buffer. This means that the second half of block B' that was originally in the output buffer will be overwritten by the first half of block D. This completes the modified SOLA processing associated with block C.

Next, the input buffer is filled with input waveform blocks E, F, and F'. Now block E replaces the role of block C in the algorithm description above, and the same operations applied to block C are now applied to block E. The only difference is that in general the optimal time shift is not necessarily SS/2 samples, but can be any integer between 0 and SS samples, and therefore the description of "first half" and "second half" above will now just be a proper portion determined by the optimal time shift. This process is then repeated for blocks G, H, and H', blocks I, J, and J', and so on.

2.4. Modified SOLA Algorithm in Accordance with Embodiments of the Present Invention In a traditional SOLA approach, nearly all of the computational complexity is in the search of the optimal time shift based on the SS+1 normalized cross-correlation values. Each cross-correlation involves an inner product of two vectors with lengths of SS samples. As mentioned earlier, the complexity of traditional SOLA may be too high for a system having limited processing resources, and great reduction of the complexity may thus be needed for a practical implementation.

In accordance with an embodiment of the present invention, the complexity of SOLA can be reduced by roughly two orders of magnitude. The reduction is achieved by calculating the normalized cross-correlation values using a decimated (i.e. down-sampled) version of the output buffer and the input template block (blocks A, C, E, G and I in FIG. 4). Suppose the output buffer is decimated by a factor of 10, and the input template block is also decimated by a factor of 10. Then, when one searches for the optimal time shift in the decimated domain, one has about 10 times fewer normalized cross-correlation values to evaluate, and each cross-correlation has 10 times fewer samples involved in the inner product. Therefore, one can save the associated computational complexity by a factor of 10×10=100. The final optimal time shift is obtained by multiplying the optimal decimated time shift by the decimation factor of 10.

Of course, the resulting optimal time shift of the foregoing approach has only one-tenth the time resolution of SOLA. However, it has been observed that the output audio quality is not very sensitive to this loss of time resolution. In fact, in trying decimation factors from 2 all the way to 16, it has been observed in limited informal listening that the output quality did not change too much.

If one wished, one could perform a refinement time shift search in the undecimated time domain in the neighborhood of the coarser optimal time shift. However, this will significantly increase the computational complexity of the algorithm (easily double or triple), and the resulting audio quality improvement is not very noticeable. Therefore, it is not clear such a refinement search is worthwhile.

Another issue with a modified implementation of SOLA in accordance with the present invention is how the decimation is performed. Classic text-book examples teach that one needs to do proper lowpass filtering before down-sampling to avoid aliasing distortion. However, even with a highly efficient third-order elliptic filter, the lowpass filtering requires even more computational complexity than the normalized cross-correlation in the decimation-by-10 example above. It has been observed that direct decimation without lowpass filtering results in output audio quality that is just as good as with lowpass filtering. In fact, if one uses the average normalized cross-correlation as a quality measure for output audio quality, then direct decimation without lowpass filtering actually achieves slightly higher scores than the text-book example of lowpass filtering followed by decimation. For this reason, in a modified SOLA algorithm in accordance with an embodiment of the present invention, direct decimation is performed without lowpass filtering.

Another benefit of direct decimation without lowpass filtering is that the resulting algorithm can handle pure tone signals with tone frequency above half of the sampling rate of the decimated signal. If one implements a good lowpass filter with high attenuation in the stop band before one decimates, then such high-frequency tone signals will be mostly filtered out by the lowpass filter, and there will not be much left in the decimated signal for the search of the optimal time shift. Therefore, it is expected that applying lowpass filtering can cause significant problems for pure tone signals with tone frequency above half of the sampling rate of the decimated signal. In contrast, direct decimation will cause the high-frequency tones to be aliased back to the base band, and a SOLA algorithm with direct decimation without lowpass filtering works fine for the vast majority of the tone frequencies, all the way up to half the sampling rate of the original undecimated input signal. In fact, tests of such a direct-decimation modified SOLA algorithm have been performed with a sweeping tone signal that has the tone frequency sweeping very slowly from 0 to 22.05 kHz. It has been observed that the direct-decimation SOLA output tone signal is fine for almost all frequencies, except occasionally the output waveform envelope dipped a little bit when the tone frequency is an integer multiple of half of the sampling rate of the decimated signal. However, such magnitude dip does not happen for every integer multiple, but only occasionally for a small number of integer multiples of half of the sampling rate of the decimated signal.

3. Detailed Description of a Modified SOLA Algorithm In Accordance with an Embodiment of the Present Invention There are many different ways to implement the input/output buffering scheme of a modified SOLA algorithm in accordance with the present invention. Some are simple and easy to understand but require more memory, while others are more efficient in memory usage but require more complicated program control and thus are more difficult to understand. In what follows below, a detailed, step-by-step description of a modified SOLA algorithm in accordance with an embodiment of the present invention is provided using the simplest I/O buffering scheme that is the easiest to understand but also uses the greatest amount of memory (e.g., data RAM). More memory efficient I/O buffering schemes will be described in the next section. Understanding the simple I/O buffering scheme in this section will be helpful for the understanding of the memory-efficient schemes in the next section.

Figure 5:
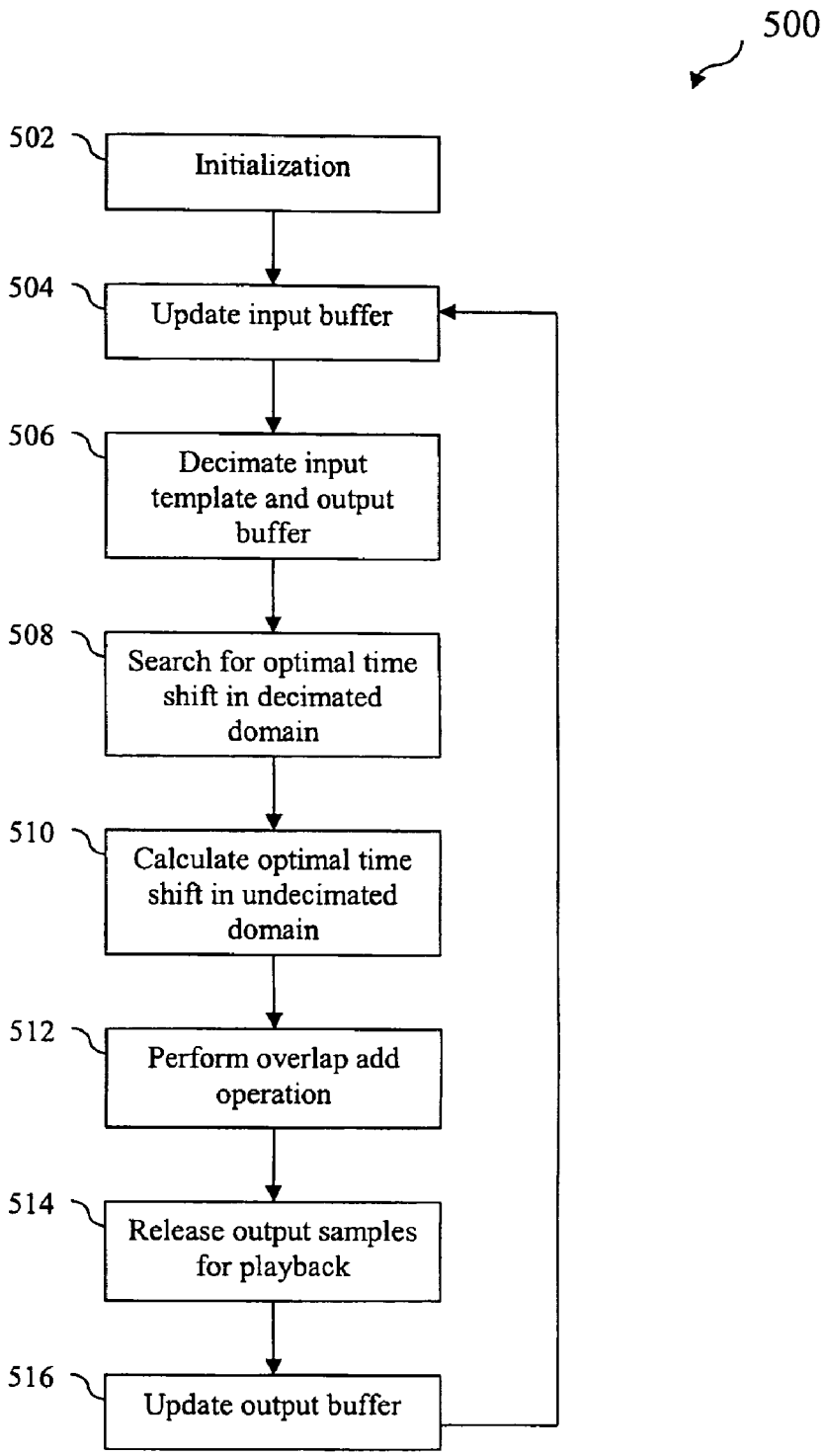
FIG. 5 is a flowchart of a modified SOLA algorithm in accordance with an embodiment of the present invention.

In this simple I/O buffering scheme, the input buffer x=[x(1), x(2), . . . x(LX)] is a vector with LX=3×SS samples, and the output buffer y=[y(1), y(2), . . . , y(LY)] is another vector with LY=2×SS samples, in correspondence with what is shown in FIG. 4. For ease of description, the following description will make use of the standard Matlab vector index notation, where x(j:k) means a vector containing the j-th element through the k-th element of the x array. Specifically, x(j:k)=[x(j), x(j+1), x(j+2), . . . , x(k−1), x(k)]. Also, for convenience, all algorithm description below assumes linear buffers with sample shifting. However, those skilled in the art will know that they can avoid the sample shifting operations by implementing equivalent operations using circular buffers. A modified SOLA algorithm in accordance with an embodiment of the present invention is now described below, wherein each step is represented in flowchart 500 of FIG. 5. Algorithm A:

1. Initialization (step 502): At the start of the modified SOLA processing of an input audio file of PCM samples, the input buffer x array is filled with the first 3×SS samples of the input audio file (blocks A, B, and B' in FIG. 4). The first SS samples of the input buffer (block A in FIG. 4), or x(1:SS), are released as output samples for play back. The last 2×SS samples of the input buffer (blocks B and B') are copied to the output buffer, so y=x(SS+1:3×SS). The algorithm will enter a loop starting from the next step.

2. Update the input buffer (step 504): If SA<LX, that is, if the speed factor β=SA/SS<3, shift the input buffer x by SA samples, i.e., x(1:LX−SA)=x(SA+1:LX), and then fill the rest of the input buffer x(LX−SA+1:LX) by SA new input audio PCM samples from the input audio file. If SA≧LX, that is, if the speed factor β=SA/SS≧3, then fill the entire input buffer x with input signal samples that are SA samples later than the last set of samples stored in the input buffer. (The input buffer now contains input blocks C, D, D', or E, F, F', etc. in FIG. 4.)

3. Decimate the input template and output buffer (step 506): The input template used for optimal time shift search is the first SS samples of the input buffer, or x(1:SS), which correspond to the blocks C, E, G, I, etc. in FIG. 4. It is directly decimated to get the decimated input template xd(1:SSD)=[x(DECF), x(2×DECF), x(3×DECF), . . . , x(SSD×DECF)], where DECF is the decimation factor, and SSD is synthesis frame size in the decimated signal domain. Normally SS=SSD×DECF. Similarly, the output buffer is also decimated to get yd(1:2×SSD)=[y(DECF), y(2×DECF), y(3×DECF), y(2×SSD×DECF)]. Note that if the memory size is really constrained, one does not need to explicitly set aside memory for the xd and yd arrays when searching for the optimal time shift in the next step; one can directly index the x and y arrays using indices that are multiples of DECF, perhaps at the cost of increased number of instruction cycles used.

4. Search for optimal time shift in decimated domain between 0 and SSD (step 508): For a given time shift k, the waveform similarity measure is the normalized cross-correlation defined as $$R(k) = \frac{\sum_{n=1}^{SSD} xd(n)yd(n+k)}{\sqrt{\sum_{n=1}^{SSd} xd^2(n) \sum_{n=1}^{SSD} yd^2(n+k)}},$$

where R(k) can be either positive or negative. To avoid the square-root operation, it is noted that finding the k that maximizes R(k) is equivalent to finding the k that maximizes $$\begin{aligned} Q(k) &= \text{sign}(R(k)) \times R^2(k) \\ &= \text{sign}\left(\sum_{n=1}^{SSD} xd(n)yd(n+k)\right) \times \frac{\left[\sum_{n=1}^{SSD} xd(n)yd(n+k)\right]^2}{\sum_{n=1}^{SSD} xd^2(n) \sum_{n=1}^{SSD} yd^2(n+k)} \end{aligned}$$

$$\text{where } \text{sign}(x) = \begin{cases} 1, & \text{if } x \geq 0 \\ -1, & \text{if } x < 0 \end{cases}.$$

Furthermore, since $$\sum_{n=1}^{SSD} xd^2(n),$$

which is the energy of the decimated input template, is independent of the time shift k, finding k that maximizes Q(k) is also equivalent to finding k that maximizes $$\begin{aligned} P(k) &= \text{sign}\left(\sum_{n=1}^{SSD} xd(n)yd(n+k)\right) \times \frac{\left[\sum_{n=1}^{SSD} xd(n)yd(n+k)\right]^2}{\sum_{n=1}^{SSD} yd^2(n+k)} \\ &= \frac{c(k)}{e(k)}, \end{aligned}$$

$$\text{where } c(k) = \text{sign}\left(\sum_{n=1}^{SSD} xd(n)yd(n+k)\right)\left[\sum_{n=1}^{SSD} xd(n)yd(n+k)\right]^2 \text{ and}$$

$$e(k) = \sum_{n=1}^{SSD} yd^2(n+k).$$

To avoid the division operation in $$\frac{c(k)}{e(k)},$$

which may be very inefficient in a DSP core, it is further noted that finding the k between 0 and SSD that maximizes P(k) involves making SSD comparison tests in the form of testing whether P(k)>P(j), or whether $$\frac{c(k)}{e(k)} > \frac{c(j)}{e(j)},$$

but this is equivalent to testing whether c(k)e(j)>c(j)e(k). Thus, the so-called "cross-multiply" technique may be used in an embodiment of the present invention to avoid the division operation. In addition, an embodiment of the present invention may calculate the energy term e(k) recursively to save computation. This is achieved by first calculating $$e(0) = \sum_{n=1}^{SSD} yd^2(n)$$

using SSD multiply-accumulate (MAC) operations. Then, for k from 1, 2, . . . to SSD, each new e(k) is recursively calculated as $e(k)=e(k-1)-yd^2(k)+yd^2(SSD+k)$ using only two MAC operations. With all this algorithm background introduced above, the algorithm to search for the optimal time shift in the decimated signal domain can now be described as follows.

$$\text{Calculate } Ey = \sum_{n=1}^{SSD} yd^2(n)$$

4.b.

$$\text{Calculate } cor = \sum_{n=1}^{SSD} xd(n)yd(n)$$

4.c. If cor>0, set cor2opt=cor×cor; otherwise, set cor2opt=−cor×cor.

4.d. Set Eyopt=Ey and set koptd=0.

4.e. For k from 1, 2, 3, . . . to SSD, do the following indented part:

4.e.i. Calculate $$Ey=Ey-yd(k)\times yd(k)+yd(SSD+k)\times yd(SSD+k).$$

4.e.ii.

$$\text{Calculate } cor = \sum_{n=1}^{SSD} xd(n)yd(n+k).$$

4.e.iii. If cor>0, set cor2=cor×cor; otherwise, set cor2=−cor×cor.

4.e.iv. If cor2×Eyopt>cor2opt×Ey, then reset koptd=k,

Eyopt=Ey, and cor2opt=cor2

4.f When the algorithm execution reaches here, the final koptd is the optimal time shift in the decimated signal domain.

5. Calculate optimal time shift in undecimated domain (step 510): The optimal time shift in the undecimated signal domain is calculated as kopt=DECF×koptd.

6. Perform overlap-add operation (step 512): Where the algorithm is implemented in software, if the program size is not constrained, it is recommended to use raised cosine as the fade-out and fade-in windows: Fade-out window:

$$w_o(n) = 0.5\times\left[1+\cos\left(\frac{n\pi}{SS+1}\right)\right], \text{ for } n = 1, 2, 3, \ldots, SS.$$

Fade-in window: $w_i(n)=1-w_o(n)$, for n=1, 2, 3, . . . , SS. Note that only one of the two windows above need to be stored as a data table. The other one can be obtained by indexing the first table from the other end in the opposite direction. If it is desirable not to store any of such windows, then we can use triangular windows and calculate the window values "on-the-fly" by adding a constant term with each new sample. The overlap-add operation is performed "in place" by overwriting the portion of the output buffer with the index range of 1+kopt to SS+kopt, as described below:

For n from 1, 2, 3, . . . to SS, do the next indented line:

$$y(n+kopt)=w_o(n)y(n+kopt)+w_i(n)\times(n)$$

7. Release output samples for play back (step 514): When the algorithm execution reaches here, the current frame of output samples stored in y(1:SS) are released for playback. These output samples should be copied to another output array before they are overwritten in the next step.

8. Update the output buffer (step 516): To prepare for the next frame, the output buffer is updated as follows.

8a. If kopt≠0, shift the overlap-added portion of the output buffer that has not been released for playback yet by SS samples. That is, y(1:kopt)=y(SS+1:SS+kopt).

8b. Fill the rest of the output buffer with new input samples after the input template in the input buffer. That is, $$y(kopt+1:2\times SS)=x(SS+1:3\times SS-kopt).$$

9. Go back to Step 2 above to process next frame.

4. More Memory-Efficient Input/Output Buffering Schemes in Accordance with Embodiments of the Present Invention The modified SOLA algorithm described in the previous section can be modified to use less memory in the input/output buffers at the cost of more complicated program control. In one version of such memory-efficient buffering schemes, the length of the input buffer can be shorter than the 3×SS samples described in the last section. The key observation that enables such a reduction is that when SA is greater than the overlap-add length, then after the overlap-add operation, the first SS samples of the input buffer are no longer needed. Therefore, rather than updating the entire output buffer in one shot in Step 8 and then shifting the input buffer in Step 2 as described in the previous section, an embodiment of the present invention can update only the first portion of the output buffer, then shift the input buffer and read new samples into the input buffer, and then complete the update of the second portion of the output buffer, possibly using new input samples just read in. This allows a shorter input buffer to be used. This basic idea is simple, but actual implementation is tricky because depending on the relationship of certain SOLA parameters, the copying operations may "run off the edge" of a buffer, and therefore requires careful checking with if statements.

In the following memory-efficient buffering scheme, a rigid requirement in the previous algorithm version described in Section 3 has been relaxed—namely, the requirement that the synthesis frame size, the overlap-add length, and the length of optimal time shift search range must all be identical. Such a constraint limits the flexibility of the design and tuning of the algorithm. It is desirable to be able to adjust these three parameters independently. This goal is achieved with the more memory-efficient algorithm described below. The symbol "SS" is still used for the synthesis frame size as before. However, to distinguish the other two parameters, the symbol "L" is used for the length of the optimal time shift search range, and the symbol "WS" for the "window size" of the sliding window for cross-correlation calculation, which is also the overlap-add window size. A minor constraint is maintained of requiring WS≧SS.

Figure 6:
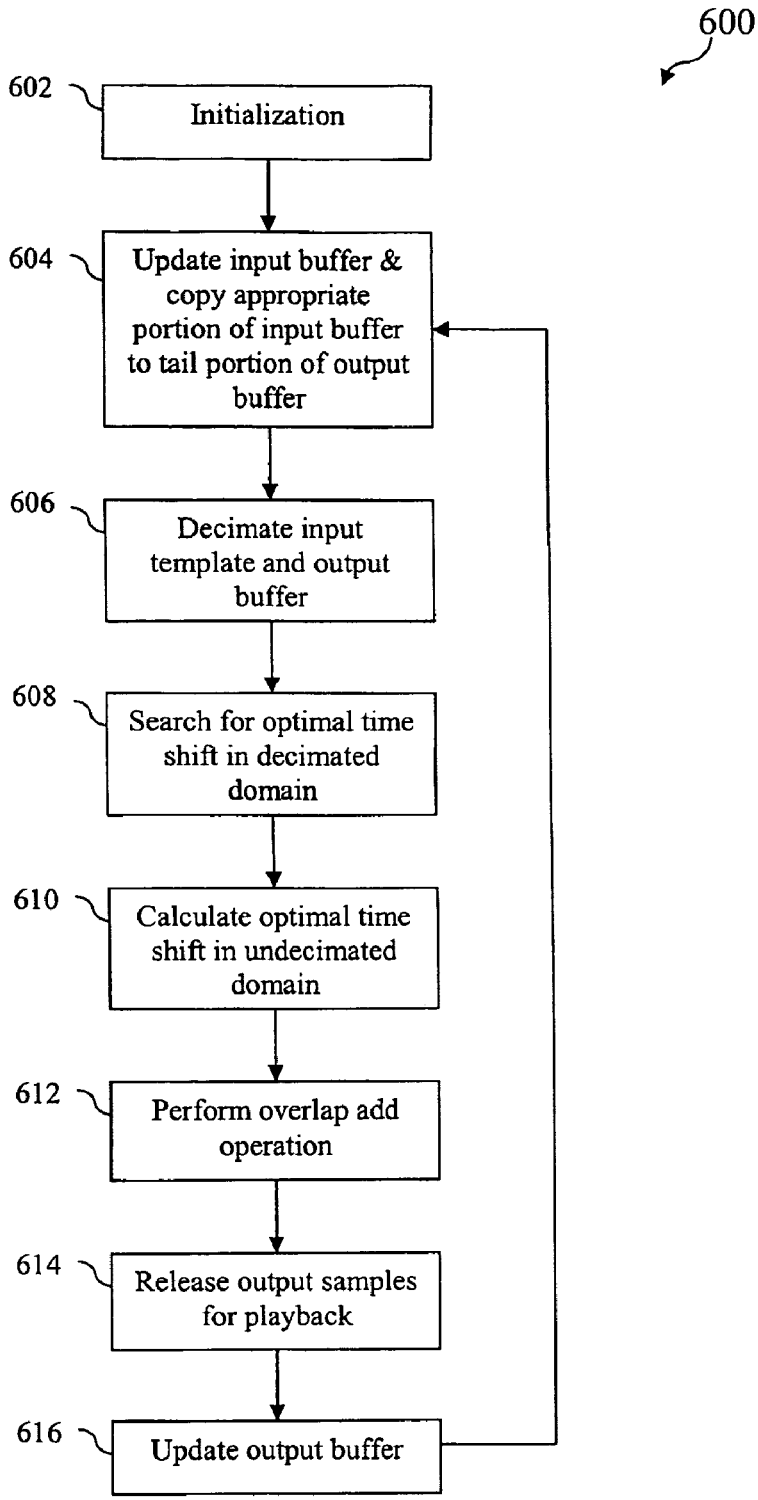
FIG. 6 is a flowchart of a modified SOLA algorithm in accordance with an alternative embodiment of the present invention.

This more memory-efficient algorithm is now described below. At a high level, the steps performed are illustrated in flowchart 600 of FIG. 6. However, the details concerning how some of the steps are performed are different than those described above with respect to Algorithm A. Where the algorithms are similar, some explanatory text has been omitted in the description of this memory-efficient version.

Algorithm B:

1. Initialization (step 602): Set N=WS+L+SS−SA. The input buffer size is LX=N if SA<N and is LX=SA if SA≧N. The output buffer size is LY=WS+L. At the start of the modified SOLA processing of an input audio file of PCM samples, the input buffer x array is filled with the first LX samples of the input audio file. The first SS samples of the input buffer, or x(1:SS), are released as output samples for play back. Then, the output buffer is prepared for entering the loop below as follows:

If SA<WS, do the next two indented lines:

Update the initial portion of the output buffer as $$y(1:WS-SS)=x(SS+1:WS)$$

Otherwise, do the following indented section:

If SA<N, do the next two indented lines:

Update the initial portion of the output buffer as $$y(1:SA-SS)=x(SS+1:SA).$$

Otherwise (if SA≧N), do the next two indented lines:

If N>0, set $y(1:SA-SS)=x(SS+1:SA)$;

Otherwise, set $y(1:LY)=x(SS+1:LY+SS)$.

After this initialization, the algorithm enters a loop starting from the next step.

2. Update the input buffer and copy appropriate portion of input buffer to the tail portion of the output buffer (step 604): If SA<LX, shift the input buffer x by SA samples, i.e., x(1:LX−SA)=x(SA+1:LX), and then fill the rest of the input buffer x(LX−SA+1:LX) by SA new input audio PCM samples from the input audio file. If SA≧LX, then fill the entire input buffer x with input signal samples that are SA samples later than the last set of samples stored in the input buffer. This completes the input buffer update. Next, an appropriate portion of this updated input buffer is copied to the tail portion of the output buffer as described below.

If SA<WS, do the next two indented lines:

Update the tail portion of the output buffer as $$y(WS-SS+kopt+1:LY)=x(WS-SA+1:LX-kopt)$$

Otherwise, if N−kopt>0, do the next two indented lines:

Update the tail portion of the output buffer as $$y(SA-SS+kopt+1:LY)=x(1:N-kopt)$$

3. Decimate the input template and output buffer (step 606): The input template used for optimal time shift search is the first SS samples of the input buffer, or x(1:SS). This input template is directly decimated to get the decimated input template xd(1:SSD)=[x(DECF), x(2×DECF), x(3×DECF), . . . , x(SSD×DECF)], where DECF is the decimation factor, and SSD is synthesis frame size in the decimated signal domain. Normally SS=SSD×DECF. Similarly, the output buffer is also decimated to get yd(1:2×SSD)=[y(DECF), y(2×DECF), y(3×DECF), . . . , y(2×SSD×DECF)]. Note that if the memory size is really constrained, one does not need to explicitly set aside memory for the xd and yd arrays when searching for the optimal time shift in the next step; one can directly index the x and y arrays using indices that are multiples of DECF, perhaps at the cost of increased number of instruction cycles used.

4. Search for optimal time shift in decimated domain between 0 and SSD (step 608): For a given time shift k, the waveform similarity measure is the normalized cross-correlation defined as $$R(k)=\frac{\sum_{n=1}^{SSD} xd(n)yd(n+k)}{\sqrt{\sum_{n=1}^{SSD} xd^2(n)\sum_{n=1}^{SSD} yd^2(n+k)}},$$

where R(k) can be either positive or negative. To avoid the square-root operation, it is noted that finding the k that maximizes R(k) is equivalent to finding the k that maximizes $$Q(k)=\text{sign}(R(k))\times R^2(k)=\text{sign}\left(\sum_{n=1}^{SSD} xd(n)yd(n+k)\right)\times\frac{\left[\sum_{n=1}^{SSD} xd(n)yd(n+k)\right]^2}{\sum_{n=1}^{SSD} xd^2(n)\sum_{n=1}^{SSD} yd^2(n+k)}$$

$$\text{where sign}(x)=\begin{cases}1, \text{ if } x\geq 0\\ -1, \text{ if } x<0\end{cases}.$$

Furthermore, since $$\sum_{n=1}^{SSD} xd^2(n),$$

which is the energy of the decimated input template, is independent of the time shift k, finding k that maximizes Q(k) is also equivalent to finding k that maximizes $$P(k)=\text{sign}\left(\sum_{n=1}^{SSD} xd(n)yd(n+k)\right)\times\frac{\left[\sum_{n=1}^{SSD} xd(n)yd(n+k)\right]^2}{\sum_{n=1}^{SSD} yd^2(n+k)}=\frac{c(k)}{e(k)},$$

-continued $$\text{where } c(k) = \text{sign}\left(\sum_{n=1}^{SSD} xd(n)yd(n+k)\right)\left[\sum_{n=1}^{SSD} xd(n)yd(n+k)\right]^2 \text{ and}$$

$$e(k) = \sum_{n=1}^{SSD} yd^2(n+k).$$

To avoid the division operation in $$\frac{c(k)}{e(k)},$$

which may be very inefficient in a DSP core, it is further noted that finding the k between 0 and SSD that maximizes P(k) involves making SSD comparison tests in the form of testing whether P(k)>P(j), or whether $$\frac{c(k)}{e(k)} > \frac{c(j)}{e(j)},$$

but this is equivalent to testing whether c(k)e(j)>c(j)e(k). Thus, the so-called "cross-multiply" technique may be used in an embodiment of the present invention to avoid the division operation. In addition, an embodiment of the present invention may calculate the energy term e(k) recursively to save computation. This is achieved by first calculating $$e(0) = \sum_{n=1}^{SSD} yd^2(n)$$

using SSD multiply-accumulate (MAC) operations. Then, for k from 1, 2, . . . to SSD, each new e(k) is recursively calculated as $e(k)=e(k-1)-yd^2(k)+yd^2(SSD+k)$ using only two MAC operations. With all this algorithm background introduced above, the algorithm to search for the optimal time shift in the decimated signal domain can now be described as follows.

$$4.a.\ \text{Calculate } Ey = \sum_{n=1}^{SSD} yd^2(n)$$

$$4.b.\ \text{Calculate } cor = \sum_{n=1}^{SSD} xd(n)yd(n)$$

4.c. If cor>0, set cor2opt=cor×cor; otherwise, set cor2opt=−cor×cor.

4.d. Set Eyopt=Ey and set koptd=0.

4.e. For k from 1, 2, 3, . . . to SSD, do the following indented part:

4.e.i. Calculate $$Ey=Ey-yd(k)\times yd(k)+yd(SSD+k)\times yd(SSD+k).$$

$$4.e.ii.\ \text{Calculate } cor = \sum_{n=1}^{SSD} xd(n)yd(n+k).$$

4.e.iii. If cor>0, set cor2=cor×cor; otherwise, set cor2=−cor×cor.

4.e.iv. If cor2×Eyopt>cor2opt×Ey, then reset koptd=k,

Eyopt=Ey, and cor2opt=cor2

4.f When the algorithm execution reaches here, the final koptd is the optimal time shift in the decimated signal domain.

5. Calculate optimal time shift in undecimated domain (step 610): The optimal time shift in the undecimated signal domain is calculated as kopt=DECF×koptd.

6. Perform overlap-add operation (step 612): If the program size is not constrained, using raised cosine as the fade-out and fade-in windows is recommended:

Fade-out window:

$$w_o(n) = 0.5\times\left[1+\cos\left(\frac{n\pi}{SS+1}\right)\right],\quad \text{for } n = 1, 2, 3, \ldots, SS.$$

Fade-in window: $w_i(n)=1-w_o(n)$, for n=1, 2, 3, . . . , SS. Note that only one of the two windows above need to be stored in as a data table. The other one can be obtained by indexing the first table from the other end in the opposite direction. If it is desirable not to store any of such windows, then we can use triangular windows and calculate the window values "on-the-fly" by adding a constant term with each new sample. The overlap-add operation is performed "in place" by overwriting the portion of the output buffer with the index range of 1+kopt to SS+kopt, as described below:

For n from 1, 2, 3, . . . to SS, do the next indented line:

$y(n+kopt)=w_o(n)y(n+kopt)+w_i(n)x(n)$.

7. Release output samples for play back (step 614): When the algorithm execution reaches here, the current frame of output samples stored in y(1:SS) are released for playback. These output samples should be copied to another output array before they are overwritten in the next step.

8. Update the output buffer (step 616): To prepare for the next frame, the output buffer is updated as follows.

8a. Shift the portion of the output buffer up to the end of the overlap-add period as follows.

$$y(1{:}WS-SS+kopt)=y(SS+1{:}WS+kopt).$$

8b. If SA≧WS, further update the portion of the output buffer right after the portion updated in step 8a above by copying the appropriate portion of the input buffer as follows.

If N−kopt>0, do the next two indented lines:

Update portion of the output buffer as $$y(WS-SS+kopt+1{:}SA-SS+kopt)=x(WS+1{:}SA).$$

Otherwise, do the next two indented lines:

Update portion of the output buffer as $$y(WS-SS+kopt+1{:}LY)=x(WS+1{:}LY+SS-kopt).$$

9. Go back to Step 2 above to process nextframe.

5. The Use of Circular Buffers to Eliminate Shifting Operations

As can be seen in Steps 2 and 8 of the algorithms in Sections 3 and 4 above, one of the main tasks in updating the input buffer and the output buffer is to shift a large portion of the older samples by a fixed number of samples. One example is the input buffer shifting operation of x(1:LX−SA)=x(SA+1:LX) in Step 2 in Section 4 above.

When the input and output buffers are implemented as linear buffers, such shifting operations involve data copying and can take a large number of processor cycles. However, most modern digital signal processors (DSPs), including the ZSP400, have built-in hardware to accelerate the "modulo" indexing required to support a so-called "circular buffer". As will be appreciated by persons skilled in the art, most DSPs today can perform modulo indexing without incurring cycle overhead. When such DSPs are used to implement circular buffers, then the sample shifting operations mentioned above can be completely eliminated, thus saving a considerable number of DSP instruction cycles.

The way a circular buffer works should be well known to those skilled in the art. However, an explanation is provided below for the sake of completeness. Take the input buffer x(1:LX) as an example. A linear buffer is just a linear array of LX samples. A circular buffer is also an array of LX samples. However, instead of having a definite beginning x(1) and a definite end x(LX) as in the linear buffer, a circular buffer is like a linear buffer that is curled around to make a circle, with x(LX) "bent" and placed right next to x(1). The way a circular buffer works is that each time this circular buffer array x(:) is indexed, the index is always put through a "modulo LX" operations, where LX is the length of the circular buffer. There is also a variable pointer that points to the "beginning" of the circular buffer, where the beginning changes with each new frame. For each new frame, this pointer is advanced by N samples, where N is the frame size.

A more specific example will help to understand how a circular buffer works. In Step 2 above, with a linear buffer, x(SA+1:LX) is copied to x(1:LX−SA). In other words, the last LX−SA samples are shifted in the linear buffer by SA samples so that they occupy the first LX−SA samples. That requires LX−SA memory read operations and LX−SA memory write operations. Then, the last SA samples of the linear buffer, or x(LX−SA+1:LX), are filled by SA new input audio PCM samples from the input audio file. In contrast, when a circular buffer is used, the LX−SA read operations and LX−SA write operations can all be avoided. The pointer p (that points to the "beginning" of the circular buffer) is simply incremented by SA, modulo LX; that is, p=modulo (p+SA, LX). This achieves the equivalent of shifting those last LX−SA samples of the frame by SA samples. Then, based on this incremented new pointer value p (and the corresponding new beginning and end of the circular buffer), the last SA samples of the "current" circular buffer are simply filled by SA new input audio PCM samples from the input audio file. Again, when the circular buffer is indexed to copy these SA new input samples, the index needs to be go through the modulo LX operation.

A DSP such as the ZSP400 can support two independent circular buffers in parallel with zero overhead for the modulo indexing. This is sufficient for the input buffer and the output buffer of the SOLA algorithms presented above (both Algorithm A and Algorithm B). Therefore, all the sample shifting operations in Algorithms A and B can be completely avoided if the input and output buffers are implemented as circular buffers using the ZSP400's built-in support for circular buffer. This will save a large number of ZSP400 instruction cycles.

6. Example Configuration for AC-3 at 44.1 kHz and 1.2× Speed

The modified SOLA algorithm described above does not take into account the frame size of the audio codec. It simply assumes that the input audio PCM samples are available as a continuous stream. In reality, typically only compressed audio bit-stream data frames are stored. Thus, in accordance with an embodiment of the present invention, an interface routine is provided to schedule the required audio decoding operation to ensure that the modified SOLA algorithm will have the necessary input audio PCM samples available when it needs to read such audio samples.

From this perspective, it may simplify the task of this interface routine if either the SOLA input frame size SA or the output frame size SS is chosen to be an integer sub-multiple or integer multiple of the frame size of the audio codec. However, doing so means one cannot use the same SA or SS values for all audio codecs, since different audio codecs have different frame sizes. Even for a given audio codec and a given set of SA and SS values, when the sampling rate changes, the same SA and SS correspond to different lengths in terms of milliseconds.

Consequently, the optimal set of SOLA parameters (SA, SS, etc.) will be different for different audio codecs, different sampling rates, and even different speed factors. This is handled in an embodiment of the present invention by carefully designing the SOLA parameter set off-line for each combination of audio codec, sampling rate, and speed factor, storing all such parameter sets in program memory, and then when the modified SOLA algorithm is executed, reading and using the correct set of parameters based on the audio codec, sampling rate, and speed factor. With three or four audio codecs (AC-3, MP3, AAC, and WMA), three sampling rates (48, 44.1, and 32 kHz), and several speed factors, there is a large number of possible combinations.

By way of example, a SOLA parameter set is provided for AC-3 at 44.1 sampling and a speed factor of 1.2. In this example configuration, the analysis frame size SA is half of the AC-3 frame size of 1536. In other words, SA=1536/2=768 samples. Since the speed factor is 1.2, the synthesis frame size is SS=SA/1.2=640 samples. This corresponds to 640/44.1=14.51 ms, which is not too far from a typical default simulation value of 15 ms. One can use a decimation factor of DECF=8, then the synthesis frame size in the decimated domain is 640/8=80 samples.

Based on this set of parameters, assuming decimation was not performed (i.e. if DECF=1), a Matlab simulation code reports that the resulting modified SOLA algorithm had a computational complexity of 57.33 MFLOPS (Mega Floating-point Operations Per Second). With 8 to 1 decimation, the same Matlab code reported the corresponding modified SOLA algorithm had a complexity of 1.11 MFLOPS. However, it was discovered that Matlab counts a MAC operation as two floating-point operations rather than one. If one counts MAC operations, such a modified SOLA algorithm will take about 0.55 million MAC operations per second. It is estimated that such a modified SOLA algorithm can be implemented in ZSP400 core in about 2 MIPS or so.

For a mono audio channel, with Algorithm A presented in Section 3 above, the input buffer x has 3×SS=3×640=1920 words, and the output buffer y has 2×SS=2×640=1280 words, for a total of 3200 words. If separate decimated xd and yd arrays are used as described in Section 3 (rather than directly indexing x and y with "index jump" of 8), then that requires additional 80+2×80=240 words, for a total of 3440 words. On the other hand, with Algorithm B presented in Section 4 above, suppose the parameters are selected such that WS=L=SS, then the input buffer x has LX=WS+L+SS−SA=1.8 SS=1152 words. This is a saving of 1920−1152=768 words. The memory sizes for the output buffer has LX=WS+L+SS−SA=1.8 SS=1152 words. This is a saving of 1920−

1152=768 words. The memory sizes for the output buffer y and decimated xd and yd arrays are the same as in Algorithm A.

7. Applying TSM to Stereo and Multi-Channel Audio

When applying a TSM algorithm to a stereo audio signal or even an audio signal with more than two channels, an issue arises: if TSM is applied to each channel independently, in general the optimal time shift will be different for different channels. This will alter the phase relationship between the audio signals in different channels, which results in greatly distorted stereo image or sound stage in general. This problem is inherent to any TSM algorithm, be it traditional SOLA, the modified SOLA algorithm described herein, or anything else.

One solution to this problem is to down-mix all the audio channels to a single mixed-down mono channel. Then, traditional or modified SOLA is applied to this mixed-down mono signal to derive the optimal time shift for each SOLA frame. This single optimal time shift is then applied to all audio channels. Since the audio signals in all audio channels are time-shifted by the same amount, the phase relationship between them is preserved, and the stereo image or sound stage is kept intact.

8. Possibilities for Further Complexity Reduction

If for any reason it is desirable to reduce the computational complexity of the modified SOLA algorithm even further, it is possible to integrate some of the prior-art SOLA complexity reduction techniques into the modified SOLA approach described herein. For example, the EM-TSM and MEM-TSM algorithms described in the following references can easily be applied to the decimated signal domain to further reduce the complexity of the modified SOLA algorithm described herein: J. W. C. Wong, O. C. Au, and P. H. W. Wong, "Fast time scale modification using envelope-matching technique (EM-TSM)," *Proceedings of IEEE International Symposium on Circuits and Systems*, Vol. 5, pp.550-553, May 1998, and P. H. W. Wong and O. C. Au, "Fast SOLA-based time scale modification using modified envelope matching," *Proceedings of* 2002 *IEEE International Conference on Acoustic, Speech, and Signal Processing*, pp. 3188-3191, May 2002. Both of these references are incorporated by reference herein in their entirety.

9. Example Computer System Implementation

Figure 7:
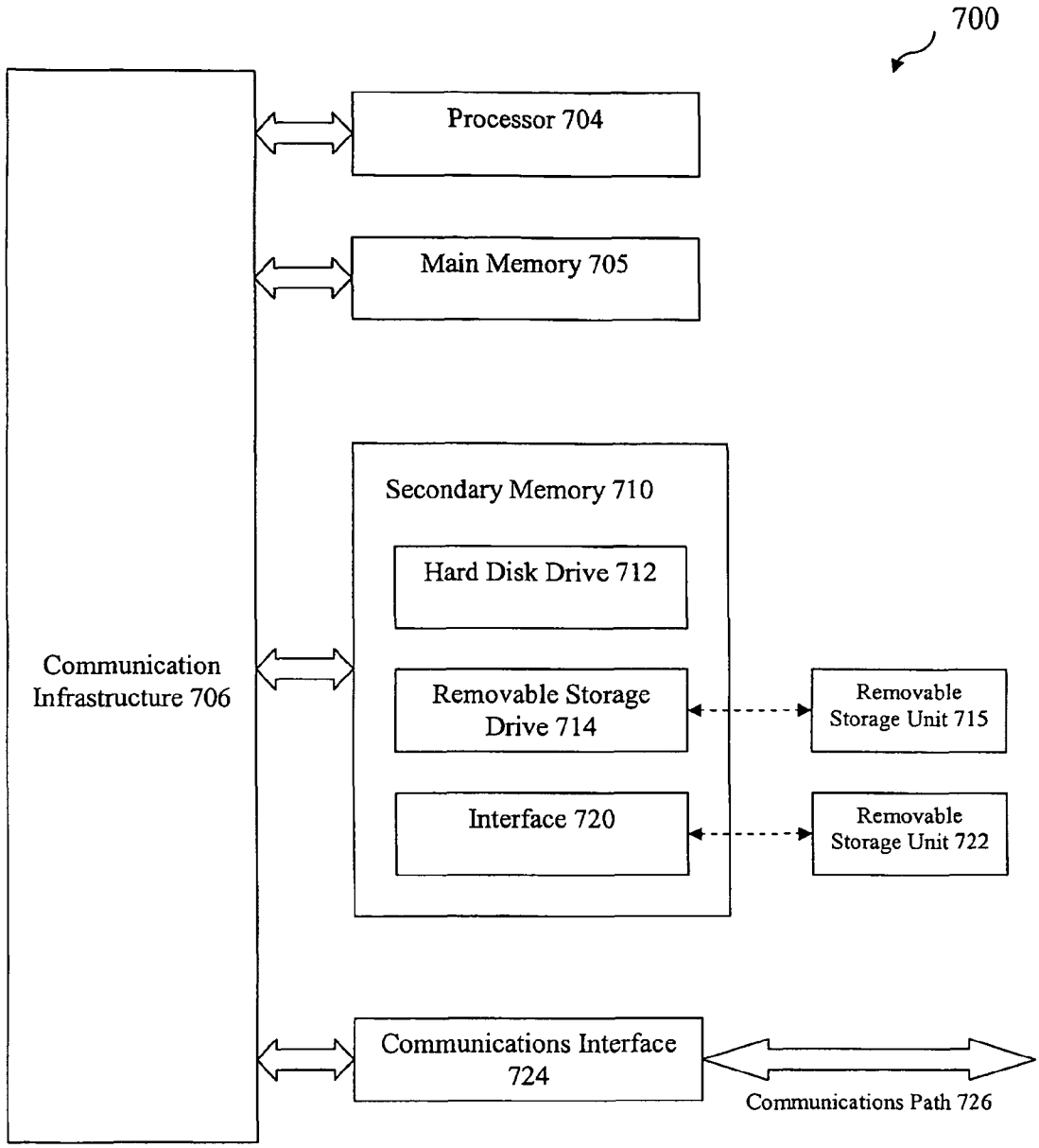
FIG. 7 is an illustration of an example computer system that may be configured to perform a time scale modification method in accordance with an embodiment of the present invention.

The following description of a general purpose computer system is provided for completeness. The present invention can be implemented in hardware, or as a combination of software and hardware. Consequently, the invention may be implemented in the environment of a computer system or other processing system. An example of such a computer system 700 is shown in FIG. 7. In the present invention, all of the signal processing blocks depicted in FIGS. 1 and 2, for example, can execute on one or more distinct computer systems 700, to implement the various methods of the present invention. The computer system 700 includes one or more processors, such as processor 704. Processor 704 can be a special purpose or a general purpose digital signal processor. The processor 704 is connected to a communication infrastructure 706 (for example, a bus or network). Various software implementations are described in terms of this exemplary computer system. After reading this description, it will become apparent to a person skilled in the art how to implement the invention using other computer systems and/or computer architectures.

Computer system 700 also includes a main memory 705, preferably random access memory (RAM), and may also include a secondary memory 710. The secondary memory 710 may include, for example, a hard disk drive 712 and/or a removable storage drive 714, representing a floppy disk drive, a magnetic tape drive, an optical disk drive, etc. The removable storage drive 714 reads from and/or writes to a removable storage unit 715 in a well known manner. Removable storage unit 715, represents a floppy disk, magnetic tape, optical disk, etc. which is read by and written to by removable storage drive 714. As will be appreciated, the removable storage unit 715 includes a computer usable storage medium having stored therein computer software and/or data.

In alternative implementations, secondary memory 710 may include other similar means for allowing computer programs or other instructions to be loaded into computer system 700. Such means may include, for example, a removable storage unit 722 and an interface 720. Examples of such means may include a program cartridge and cartridge interface (such as that found in video game devices), a removable memory chip (such as an EPROM, or PROM) and associated socket, and other removable storage units 722 and interfaces 720 which allow software and data to be transferred from the removable storage unit 722 to computer system 700.

Computer system 700 may also include a communications interface 724. Communications interface 724 allows software and data to be transferred between computer system 700 and external devices. Examples of communications interface 724 may include a modem, a network interface (such as an Ethernet card), a communications port, a PCMCIA slot and card, etc. Software and data transferred via communications interface 724 are in the form of signals which may be electronic, electromagnetic, optical or other signals capable of being received by communications interface 724. These signals are provided to communications interface 724 via a communications path 726. Communications path 726 carries signals and may be implemented using wire or cable, fiber optics, a phone line, a cellular phone link, an RF link and other communications channels. Examples of signals that may be transferred over interface 724 include: signals and/or parameters to be coded and/or decoded such as speech and/or audio signals and bit stream representations of such signals; any signals/parameters resulting from the encoding and decoding of speech and/or audio signals; signals not related to speech and/or audio signals that are to be processed using the techniques described herein.

In this document, the terms "computer program medium," "computer program product" and "computer usable medium" are used to generally refer to media such as removable storage unit 718, removable storage unit 722, a hard disk installed in hard disk drive 712, and signals carried over communications path 726. These computer program products are means for providing software to computer system 700.

Computer programs (also called computer control logic) are stored in main memory 705 and/or secondary memory 710. Also, decoded speech segments, filtered speech segments, filter parameters such as filter coefficients and gains, and so on, may all be stored in the above-mentioned memories. Computer programs may also be received via communications interface 724. Such computer programs, when executed, enable the computer system 700 to implement the present invention as discussed herein. In particular, the computer programs, when executed, enable the processor 704 to implement the processes of the present invention, such as methods in accordance with flowchart 500 of FIG. 5 and flowchart 600 of FIG. 6, for example. Accordingly, such computer programs represent controllers of the computer system 700. Where the invention is implemented using software, the software may be stored in a computer program product and loaded into computer system 700 using removable storage drive 714, hard drive 712 or communications interface 724.

In another embodiment, features of the invention are implemented primarily in hardware using, for example, hardware components such as application specific integrated circuits (ASICs) and gate arrays. Implementation of a hardware state machine so as to perform the functions described herein will also be apparent to persons skilled in the art.

10. Conclusion

The foregoing provided a detailed description of a modified SOLA algorithm in accordance with an embodiment of the present invention that produces fairly good output audio quality with a very low complexity. This modified SOLA algorithm achieves complexity reduction by performing the maximization of normalized cross-correlation using decimated signals. Many related issues have been discussed, and an example configuration of the modified SOLA algorithm for AC-3 at 44.1 kHz was given. With its good audio quality and low complexity, this modified SOLA algorithm is well-suited for use in audio speed up application for PVRs.

While various embodiments of the present invention have been described above, it should be understood that they have been presented by way of example only, and not limitation. It will be understood by those skilled in the relevant art(s) that various changes in form and details may be made therein without departing from the spirit and scope of the invention as defined in the appended claims. Accordingly, the breadth and scope of the present invention should not be limited by any of the above-described exemplary embodiments, but should be defined only in accordance with the following claims and their equivalents.

I claim:

1. A method for time scale modifying an input audio signal, comprising:

decimating a first waveform segment of the input audio signal by a decimation factor to produce a decimated first waveform segment;

decimating a portion of a second waveform segment of the input audio signal by the decimation factor to produce a decimated portion of the second waveform segment;

calculating a waveform similarity measure or waveform difference measure between the decimated portion of the second waveform segment of the input audio signal and each of a plurality of portions of the decimated first waveform segment of the input audio signal to identify an optimal time shift in a decimated domain;

identifying an optimal time shift in an undecimated domain based on the identified optimal time shift in the decimated domain, wherein identifying the optimal time shift in the undecimated domain based on the identified optimal time shift in the decimated domain comprises multiplying the identified optimal time shift in the decimated domain by the decimation factor;

overlap adding a portion of the first waveform segment identified by the optimal time shift in the undecimated domain with the portion of the second waveform segment to produce an overlap-added waveform segment; and providing at least a portion of the overlap-added waveform segment as a time scale modified audio output signal.

2. The method of claim 1, wherein calculating the waveform similarity measure or waveform difference measure between the decimated portion of the second waveform segment and each of the plurality of portions of the decimated first waveform segment comprises:

performing a normalized cross correlation between the decimated portion of the second waveform segment and each of the plurality of portions of the decimated first waveform segment.

3. The method of claim 1, further comprising:

storing the first waveform segment of the input audio signal in an output buffer prior to decimating the first waveform segment; and storing the second waveform segment of the input audio signal in an input buffer prior to decimating the portion of the second waveform segment.

4. The method of claim 3, wherein at least one of the input buffer and the output buffer is a circular buffer.

5. The method of claim 3, further comprising:

replacing a portion of the first waveform segment in the output buffer with the overlap-added waveform segment.

6. The method of claim 5, further comprising updating the input buffer and the output buffer, wherein updating the input buffer and the output buffer comprises:

updating a portion of the output buffer, the portion including the overlap-added waveform segment;

updating at least a portion of the input buffer;

reading a new waveform segment of the input audio signal into the input buffer; and copying at least a portion of the new waveform segment from the input buffer to the output buffer.

7. The method of claim 1, wherein identifying an optimal time shift in an undecimated domain based on the identified optimal time shift in the decimated domain further comprises:

identifying the result of the multiplication as a coarse optimal time shift;

performing a refinement time shift search around the coarse optimal time shift in the undecimated domain.

8. The method of claim 1, wherein decimating the first waveform segment of the input audio signal and decimating the portion of the second waveform segment of the input audio signal comprises:

decimating the first waveform segment and the portion of the second waveform segment without first low-pass filtering either the first waveform segment or the portion of the second waveform segment.

9. The method of claim 1, wherein the first waveform segment comprises two contiguous frames of a fixed frame size SS and the second waveform segment comprises three contiguous frames of the fixed frame size SS.

10. The method of claim 9, wherein each of the plurality of portions of the decimated first waveform segment is comprised of samples from the last two contiguous frames of the three contiguous frames of the second waveform segment.

11. The method of claim, wherein each of the plurality of portions of the decimated first waveform segment is of the same length.

12. The method of claim 1, wherein overlap adding the portion of the first waveform segment identified by the optimal time shift in the undecimated domain with the portion of the second waveform segment comprises:

multiplying the portion of the first waveform segment identified by the optimal time shift in the undecimated domain by a fade-out window to produce a first windowed portion;

multiplying the portion of the second waveform segment by a fade-in window to produce a second windowed portion; and adding the first windowed portion and the second windowed portion.

13. A system for time scale modifying an input audio signal, comprising:

an input buffer;

an output buffer; and time scale modification (TSM) logic coupled to the input buffer and the output buffer;

wherein the TSM logic is configured to decimate a first waveform segment of the input audio signal stored in the output buffer by a decimation factor to produce a decimated first waveform segment and to decimate a portion of a second waveform segment of the input audio signal stored in the input buffer by the decimation factor to produce a decimated portion of the second waveform segment, wherein the TSM logic is further configured to calculate a similarity measure between the decimated portion of the second waveform segment and each of a plurality of portions of the decimated first waveform segment to identify an optimal time shift in a decimated domain and to identify an optimal time shift in an undecimated domain based on the identified optimal time shift in the decimated domain, wherein the TSM logic is configured to identify the optimal time shift in the undecimated domain based on the identified optimal time shift in the decimated domain by multiplying the identified optimal time shift in the decimated domain by the decimation factor, and wherein the TSM logic is further configured to overlap add a portion of the first waveform segment identified by the optimal time shift in the undecimated domain with the portion of the second waveform segment to produce an overlap-added waveform segment and to store at least a portion of the overlap-added waveform segment in the output buffer for output as a time scale modified audio output signal.

14. The system of claim 13, wherein the TSM logic is configured to calculate the similarity measure between the decimated portion of the second waveform segment and each of the plurality of portions of the decimated first waveform segment by performing a normalized cross correlation between the decimated portion of the second waveform segment and each of the plurality of portions of the decimated first waveform segment.

15. The system of claim 13, wherein at least one of the input buffer and the output buffer is a circular buffer.

16. The system of claim 13, wherein the TSM logic is further configured to identify an optimal time shift in an undecimated domain based on the identified optimal time shift in the decimated domain by identifying the result of the multiplication as a coarse optimal time shift and by performing a refinement time shift search around the coarse optimal time shift in the undecimated domain.

17. The system of claim 13, wherein the TSM logic is configured to decimate the first waveform segment and the portion of the second waveform segment without first low-pass filtering either the first waveform segment or the portion of the second waveform segment.

18. The system of claim 13, wherein the first waveform segment comprises two contiguous frames of a fixed frame size SS and the second waveform segment comprises three contiguous frames of the fixed frame size SS.

19. The system of claim 18, wherein each of the plurality of portions of the decimated first waveform segment is comprised of samples from the last two contiguous frames of the three contiguous frames of the second waveform segment.

20. The system of claim 13, wherein each of the plurality of portions of the decimated first waveform segment is of the same length.

21. The system of claim 13, wherein the TSM logic is configured to overlap add the portion of the first waveform segment identified by the optimal time shift in the undecimated domain with the portion of the second waveform segment by multiplying the portion of the first waveform segment identified by the optimal time shift in the undecimated domain by a fade-out window to produce a first windowed portion, multiplying the portion of the second waveform segment by a fade-in window to produce a second windowed portion, and adding the first windowed portion and the second windowed portion.

22. A computer program product comprising a non-transitory computer useable medium having computer program logic recorded thereon for enabling a processor in a computer system to time scale modify an input audio signal, the computer program logic comprising:

first means for enabling the processor to calculate a waveform similarity measure between a decimated portion of a second waveform segment of the input audio signal and each of a plurality of portions of a decimated first waveform segment of the input audio signal to identify an optimal time shift in a decimated domain;

second means for enabling the processor to identify an optimal time shift in an undecimated domain based on the identified optimal time shift in the decimated domain, wherein the second means comprises means for enabling the processor to multiply the identified optimal time shift in the decimated domain by a decimation factor;

third means for enabling the processor to overlap add a portion of the first waveform segment identified by the optimal time shift in the undecimated domain with the portion of the second waveform segment to produce an overlap-added waveform segment;

fourth means for enabling the processor to provide at least a portion of the overlap-added waveform segment as a time scale modified audio output signal;

fifth means for enabling the processor to decimate the first waveform segment of the input audio signal by the decimation factor to produce the decimated first waveform segment; and sixth means for enabling the processor to decimate a portion of the second waveform segment of the input audio signal by the decimation factor to produce the decimated portion of the second waveform segment.

23. The computer program product of claim 22, wherein the first means comprises means for performing a normalized cross correlation between the decimated portion of the second waveform segment and each of the plurality of portions of the decimated first waveform segment.

24. The computer program product of claim 22, wherein the computer program logic further comprises:

seventh means for enabling the processor to store the first waveform segment of the input audio signal in an output buffer prior to decimating the first waveform segment; and eighth means for enabling the processor to store the second waveform segment of the input audio signal in an input buffer prior to decimating the portion of the second waveform segment.

25. The computer program product of claim 22, wherein the second means further comprises:

means for enabling the processor to identify the result of the multiplication as a coarse optimal time shift; and means for enabling the processor to perform a refinement time shift search around the coarse optimal time shift in the undecimated domain.

26. The computer program product of claim 22, wherein the fifth means comprises means for enabling the processor to decimate the first waveform segment without first low-pass filtering the first waveform segment and the sixth means comprises means for enabling the processor to decimate the portion of the second waveform segment without first low-pass filtering the portion of the second waveform segment.

27. The computer program product of claim 22, wherein the first waveform segment comprises two contiguous frames of a fixed frame size SS and the second waveform segment comprises three contiguous frames of the fixed frame size SS.

28. The computer program product of claim 27, wherein each of the plurality of portions of the decimated first waveform segment is comprised of samples from the last two contiguous frames of the three contiguous frames of the second waveform segment.

29. The computer program product of claim 22, wherein each of the plurality of portions of the decimated first waveform segment is of the same length.

30. The computer program product of claim 22, wherein the third means comprises:

means for enabling the processor to multiply the portion of the first waveform segment identified by the optimal time shift in the undecimated domain by a fade-out window to produce a first windowed portion;

means for enabling the processor to multiply the portion of the second waveform segment by a fade-in window to produce a second windowed portion; and means for enabling the processor to add the first windowed portion and the second windowed portion.

31. A system for time scale modifying an input audio signal, comprising:

an input buffer;

an output buffer; and time scale modification (TSM) logic coupled to the input buffer and the output buffer;

wherein the TSM logic is configured to decimate a first waveform segment of the input audio signal stored in the output buffer by a decimation factor to produce a decimated first waveform segment and to decimate a portion of a second waveform segment of the input audio signal stored in the input buffer by the decimation factor to produce a decimated portion of the second waveform segment, wherein the TSM logic is further configured to calculate a difference measure between the decimated portion of the second waveform segment and each of a plurality of portions of the decimated first waveform segment to identify an optimal time shift in a decimated domain and to identify an optimal time shift in an undecimated domain based on the identified optimal time shift in the decimated domain, wherein the TSM logic is configured to identify the optimal time shift in the undecimated domain based on the identified optimal time shift in the decimated domain by multiplying the identified optimal time shift in the decimated domain by the decimation factor, and wherein the TSM logic is further configured to overlap add a portion of the first waveform segment identified by the optimal time shift in the undecimated domain with the portion of the second waveform segment to produce an overlap-added waveform segment and to store at least a portion of the overlap-added waveform segment in the output buffer for output as a time scale modified audio output signal.

32. A computer program product comprising a non-transitory computer useable medium having computer program logic recorded thereon for enabling a processor in a computer system to time scale modify an input audio signal, the computer program logic comprising:

first means for enabling the processor to calculate a waveform difference measure between a decimated portion of a second waveform segment of the input audio signal and each of a plurality of portions of a decimated first waveform segment of the input audio signal to identify an optimal time shift in a decimated domain;

second means for enabling the processor to identify an optimal time shift in an undecimated domain based on the identified optimal time shift in the decimated domain, wherein the second means comprises means for enabling the processor to multiply the identified optimal time shift in the decimated domain by a decimation factor;

third means for enabling the processor to overlap add a portion of the first waveform segment identified by the optimal time shift in the undecimated domain with the portion of the second waveform segment to produce an overlap-added waveform segment; and fourth means for enabling the processor to provide at least a portion of the overlap-added waveform segment as a time scale modified audio output signal.

33. A method for time scale modifying a plurality of audio signals, wherein each of the audio signals is associated with a different audio channel, the method comprising:

down-mixing the plurality of audio signals to produce a mixed-down audio signal;

calculating a waveform similarity measure or waveform difference measure to identify an optimal time shift in a decimated domain between first and second waveform segments of the mixed-down audio signal;

multiplying the identified optimal time shift in the decimated domain by a decimation factor to identify an optimal time shift in an undecimated domain based on the identified optimal time shift in the decimated domain; and overlap adding first and second waveform segments of each of the plurality of audio signals based on the optimal time shift in the undecimated domain to produce a plurality of time scale modified audio signals.

* * * * *